US005555746A

United States Patent [19]

Thompson

[11] Patent Number: 5,555,746

[45] Date of Patent: Sep. 17, 1996

[54] TWO LITER INSULATED COOLER CONTAINERS

[76] Inventor: Patrick Thompson, 2328 Burns Ave., Melbourne, Fla. 32935

[21] Appl. No.: 488,789

[22] Filed: Jun. 8, 1995

[51] Int. Cl.[6] ..... F25D 3/08

[52] U.S. Cl. ..... 62/457.4; 62/371; 220/739; 220/740; 220/755; 220/771; 215/396

[58] Field of Search ..... 62/457.3, 457.4, 62/457.8, 371; 220/737, 740, 741, 742, 755, 771; 215/395, 396

[56] References Cited

U.S. PATENT DOCUMENTS

| | | | |
|---|---|---|---|
| 4,580,412 | 4/1986 | Wells | 62/372 |
| 4,798,063 | 1/1989 | Rimmer | 62/457.4 |
| 4,921,141 | 5/1990 | Branum | 222/146.6 |
| 4,931,333 | 6/1990 | Henry | 428/76 |
| 4,986,089 | 1/1991 | Raab | 62/457.4 |
| 5,067,328 | 11/1991 | Medina et al. | 62/457.2 |
| 5,207,076 | 5/1993 | Sciarrillo | 62/457.4 |
| 5,212,963 | 5/1993 | McGinnis | 62/457.4 |
| 5,275,015 | 1/1994 | Brossia et al. | 62/372 |
| 5,406,808 | 4/1995 | Babb et al. | 62/371 |

*Primary Examiner*—John M. Sollecito
*Attorney, Agent, or Firm*—Brian S. Steinberger

[57] ABSTRACT

Portable containers for insulating and supporting disposable plastic 1, 2 and 3 liter bottles. A first embodiment includes a foamed plastic polystryrene type housing with molded handle. Pitcher type model with can fixably and snugly support the liter bottle therein. An alternative includes a removable refrigerant material such as Blue-Ice can be inserted within the interior bottom of the housing. A top portion is snapably or threadably detached from the housing. The housing is shaped to closely conform to a standard 1, 2 or 3 liter bottle. A second embodiment has double walls with the refrigerant material or insulative foam there-between. A third embodiment has a bottom portion of the housing detachable from the rest and can also contain a cold pack of refrigerant material which can be prefrozen by itself before using the invention. The fourth and fifth embodiments utilize wet-suit type outer housings with zippers and plastic type handles. The fifth embodiment includes another removable ice-pack that can be prefrozen before the invention is being used.

9 Claims, 6 Drawing Sheets

100 B

100 B

Fig. 2B
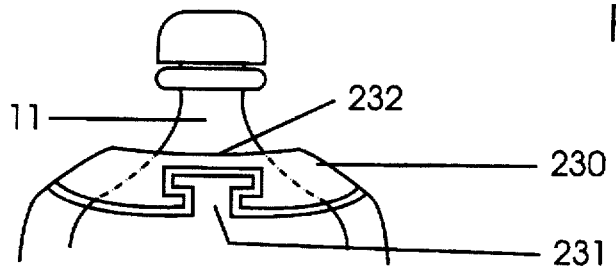
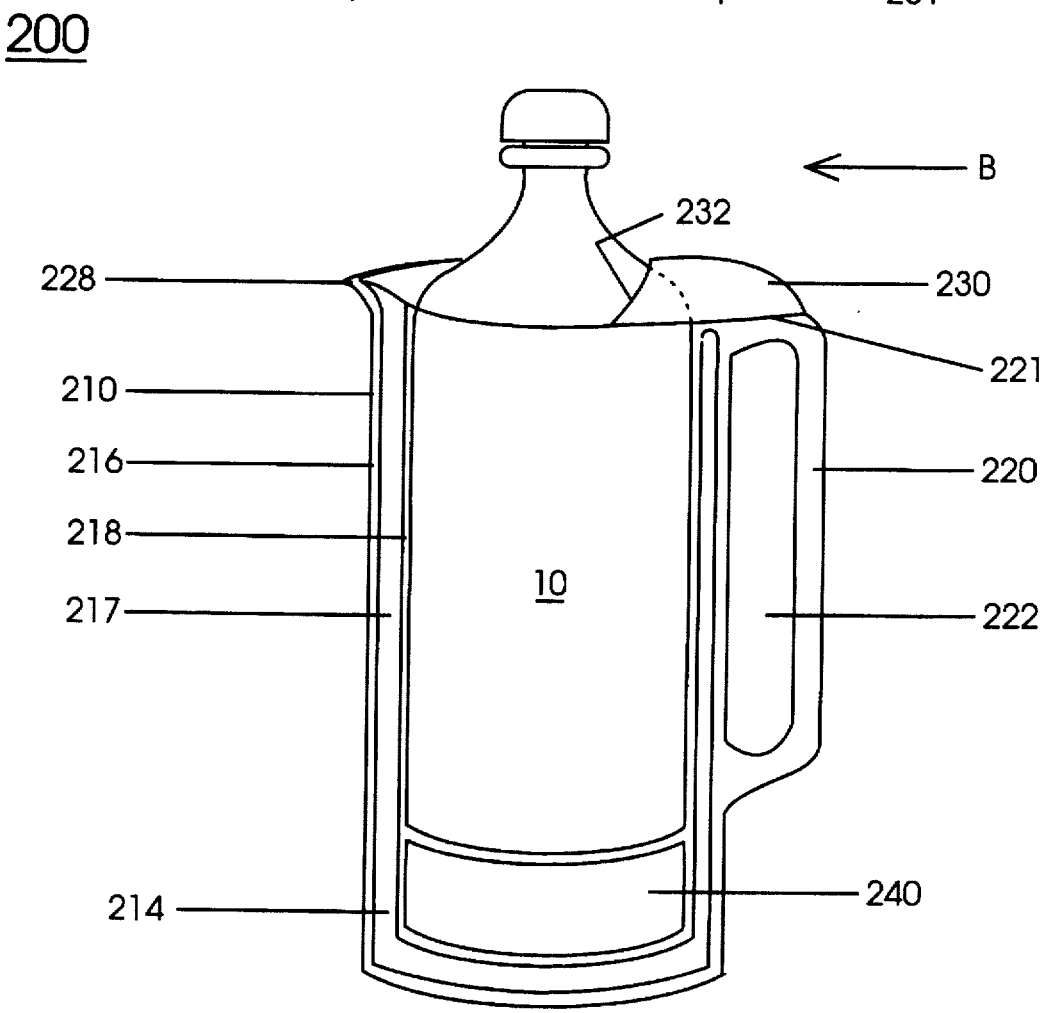
Fig. 2A

TWO LITER INSULATED COOLER CONTAINERS

BACKGROUND AND PRIOR ART

Two liter plastic type bottles are standard and popular containers for holding all types of liquids such as soda pop, seltzer and juices. Because of the extended time it would take to finish off the contents of one bottle, the bottles need to be refrigerated. For example, the normal time needed for a single person to finish off on a 2 liter bottle on a hot day would take at least several hours. By the time these 2 liter bottles are half empty, their contents are no longer cold and have become luke warm. The problem is exasperated in warm climate locations in the summer or in climates such as Florida where people work and/or have active lives outdoors. Typically a 2 or 3 liter bottle is usually sufficient to supply the average person with soda pop for an 8 to 10 hour period or during a standard work shift. Large styrofoam block type coolers are inadequate for cooling a single 1, 2, or 3 liter bottles. Futhermore, large sytrofoam block coolers are also cumbersome to carry and also require bags of ice which add expense and weight to the endeavor. Traditional cylindrical type thermoses are also inadequate since the contents of the 2 liter bottle itself would have to be drained into the cylindrical thermos container. Furthermore, using typical plastic type pitchers and filling the contents with ice is also inadequate, because as the ice melts, the contents then become watered down. Furthermore, pouring out the contents of the liter bottles into thermoses and pitchers significantly reduces the amount of carbonation in the soda and generally causes the soda to become flat and thus ruin the flavor. U.S. Pat. Nos. 4,580,412 to Wells; 4,921,141 to Branum; 4,931,333 to Henry; 4,986,089 to Raab; 5,067,328 to Medina et al.; 5,207,076 to Sciarrillo; and 5,275,015 to Brossia et al. describe various types of prior art devices that do not solve the above mentioned problems.

Thus, the need exists for an adequate storage container for keeping the contents of 1, 2 and 3 liter bottles chilled.

SUMMARY OF THE INVENTION

The first objective of the present invention is to provide a container for keeping the contents of 1, 2 and 3 liter bottles chilled for extended periods of time.

The second object of this invention is to provide a container with a handle for supporting a standard 1, 2 and 3 liter bottle.

The third object of this invention is to provide a container with a removable top which allows a 1, 2 and 3 liter bottle to become a pitcher for the contents of the bottle.

The fourth object of this invention is to provide a cooler container for a 1, 2 and 3 liter bottle with a removable portion that can be refrigerated prior to use.

The fifth object of this invention is to provide for an insulative sleeve that substantially conforms to and supports a standard 1, 2 and 3 liter bottle.

Various embodiments of this invention are useful for various uses, such as at home, during picnics, hiking and on the job.

Further objects and advantages of this invention will be apparent from the following detailed description of a presently preferred embodiment which is illustrated schematically in the accompanying drawings.

BRIEF DESCRIPTION OF THE FIGURES

FIG. 2A is a cross-sectional view of a second preferred embodiment of the cooler invention.

FIG. 2B is a side view along arrow B of the top portion of the embodiment of FIG. 2A.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. A main purpose of this invention is to maintain the chilled contents of a standardized disposable beverage bottle. Similarly, the invention can maintain the temperature of a heated contents. The following drawings illustrate a 2 liter bottle but are not limited to a 2 liter bottle. Alternatively, a standard wine bottle, 1 quart beer bottles, 1 and 3 liter bottles can also be included. Also, the terminology used herein is for the purpose of description and not of limitation.

FIRST PREFERRED EMBODIMENT

Figure 1A:
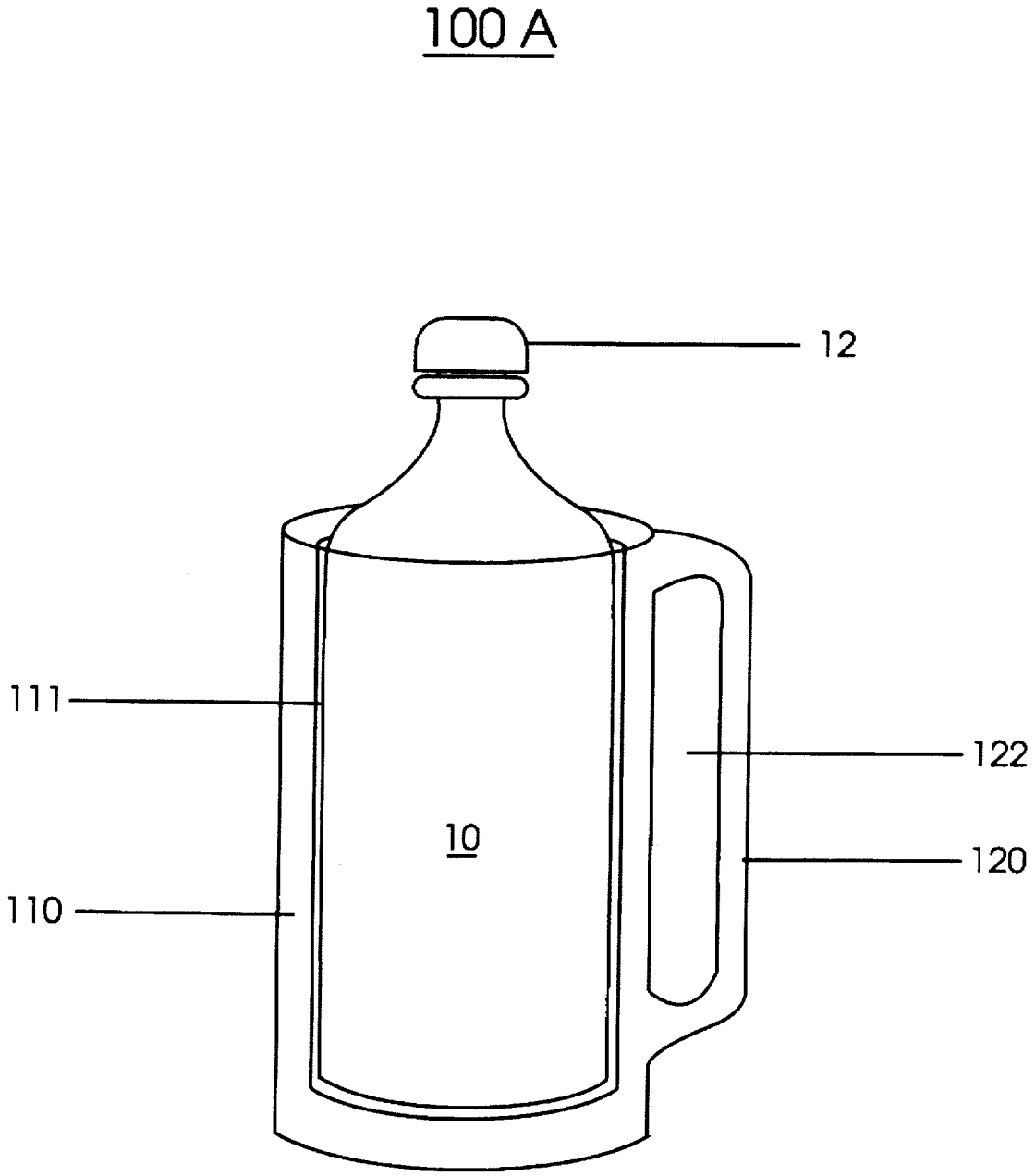
FIG. 1A is a cross-sectional view of a first preferred basic embodiment of the cooler invention.

FIG. 1A is a cross-sectional view of a first preferred basic embodiment 100A of the cooler invention. Basic embodiment 100A can be used for a tabletop. Component 10 refers to a standard 1, 2 or 3 liter plastic type disposable bottle container that are currently sold over the counter in convenience stores and the like. A main outer casing 110 can be formed of a molded high density plastic foam material such as but not limited to styrofoam, polystyrene, and the like. The material used for casing 110 can insulate the contents of the bottle 10 stored within. The interior surface 111, can be shaped in order to closely match the contours of a standard 1, 2 or 3 liter disposable plastic bottle 10 and is frictionally tight in order to minimize slippage of the bottle 10 when pouring. On one side of casing 110, a raised rounded handle portion 120 can be formed by the molded high density plastic foam material for use to be held by a human hand. An indented recess layer 122 is disposed in a plane radially extending from the casing 110. The handle further has a raised continuous rounded perimeter edge 120 with a vertical portion disposed parallel to a side wall of the casing and two horizontal portions disposed substantially perpendicular to the side wall of the casing. Each horizontal portion is respectively connected at one end to an upper and lower point on the side wall and each horizontal portion is respectively attached at an other end to opposite ends of the vertical portion, so that the raised continuous rounded perimeter edge and the side wall thereby enclose a flat area and the indented recess layer is circumscribed by and contiguously attached to the side wall and the raised continuous rounded perimeter edge, the handle is formed of the same material aids in strengthening the connection of the rounded handle portion 120 to a side wall of casing 110.

Figure 1B:
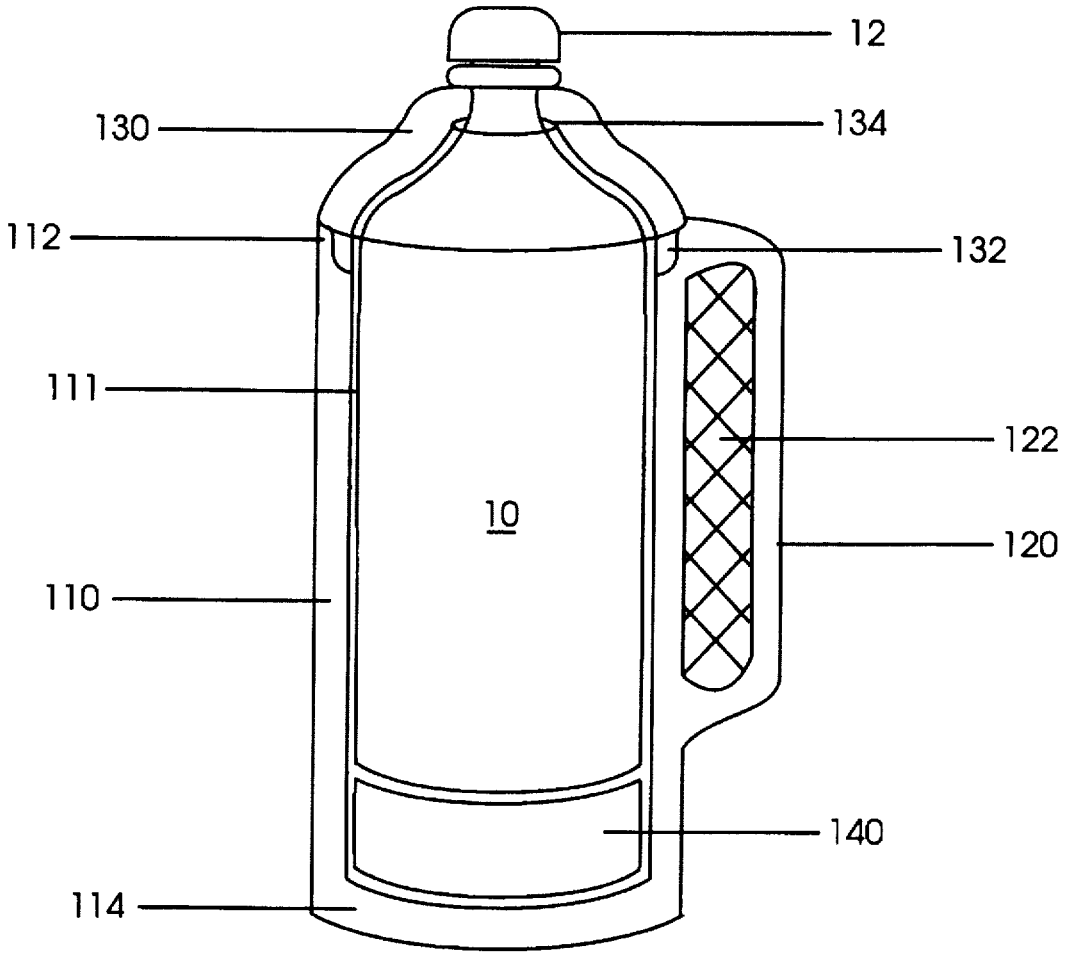
FIG. 1B is a cross-sectional view of an alternative modification to the first preferred embodiment.

FIG. 1B illustrates an alternative embodiment of FIG. 1A with a separate lid portion 130 and base portions 114, 140 that will now be discussed. The top portion of the casing 110 can have a removable top 130 whose purpose is to keep the 1, 2 or 3 liter bottle 10 in place. Top portion 130 has a thread portion 132 which has a mateable portion 112 on the container body 110. Alternatively, mateable connect portions 112, 132 can be a snap lid type. Top portion 130 has an opening at the top end 134 which allows for the neck of the 1, 2 or 3 liter bottle 10 to project out therefrom. Thus, the cap 12 of the bottle 10 can be unscrewed and the bottle 10 used while held within the container 100. The bottom portion 114 of casing 110 is extended below the base of bottle 10 to support a removable pack 140 that can comprise freezable refrigerant material gel such as Blue-Ice, a plastic bag of ice, and the like. Refrigerant materials 140 should be removable prior to the insertion of bottle 10 when cooler invention 100B is used. Refrigerant materials 140 can be frozen by insertion into freezers and installed in the bottom portion 114 of the cooler invention 100 prior to insertion of bottle 10.

SECOND PREFERRED EMBODIMENT

FIG. 2A is a cross-sectional view of a second preferred embodiment 200 of the cooler invention. Casing 210 can be formed of the same materials used in casing 110 of FIG. 1. A non-toxic plastic material can be used for forming the walls of casing 210. In FIG. 2A, casing 210 is comprised of double walls 216 and 218 which can be filled with a liquid gel refrigerant material 217 such as blue-ice, a non freezable solution, water and the like. Alternatively, insulation material such as but not limited to injection foam can also be used. Double walls 216 and 218 can be formed from injection molding and the like. Similar to FIG. 1, inner wall 218 can be formed to subtantially conform to the outer walls of a standard disposable plastic 1, 2 or 3 liter bottles. The bottom portion 214 of casing 210 can also include an extended portion for supporting more refrigerant material 240 within or alternatively as a separate insert. As the latter, insert 240 can be prefrozen separately or within the casing 210 before bottle 10 is inserted within the casing 210. Alternatively, bottom portion 214 can be a solid plastic foam such as that used on double walls 216 and 218. Container 210 can include a handle portion 220 which projects out from one side with an open portion 222 or alternatively a solid indented portion such as area 122 described in FIG. 1. One side of the top portion of casing 210 can include a protruding lip portion 228 which enables the cooler to resemble a pitcher. Before use, the entire cooler embodiment 200 is stored in either a refrigerator or a freezer.

Referring to FIG. 2A, a slidable lid portion 230 is used to keep the bottle 10 in place when the entire cooler 200 is used as a pitcher. Alternatively, cooler emodiment 200 can be used without bottle 10 in place. For example, liquid can be stored directly within the main portion of inner wall 218 when the 2 liter bottle 10 is not being used.

FIG. 2B is a side view along arrow B of the top portion of the embodiment of FIG. 2A. Lid 230 slides on the main casing 210 in the direction of arrow B in order to retain bottle 10 within the casing 210 when pouring. Lid 230 has an underside T shaped groove 23 1 which mateably slides over a protruding T-shaped portion on the top 221 of handle 220. Curved side 232 retains bottle neck 11 in place when lid 230 is slid on main casing 210 in the direction of arrow B.

THIRD PREFERRED EMBODIMENT

Figure 3:
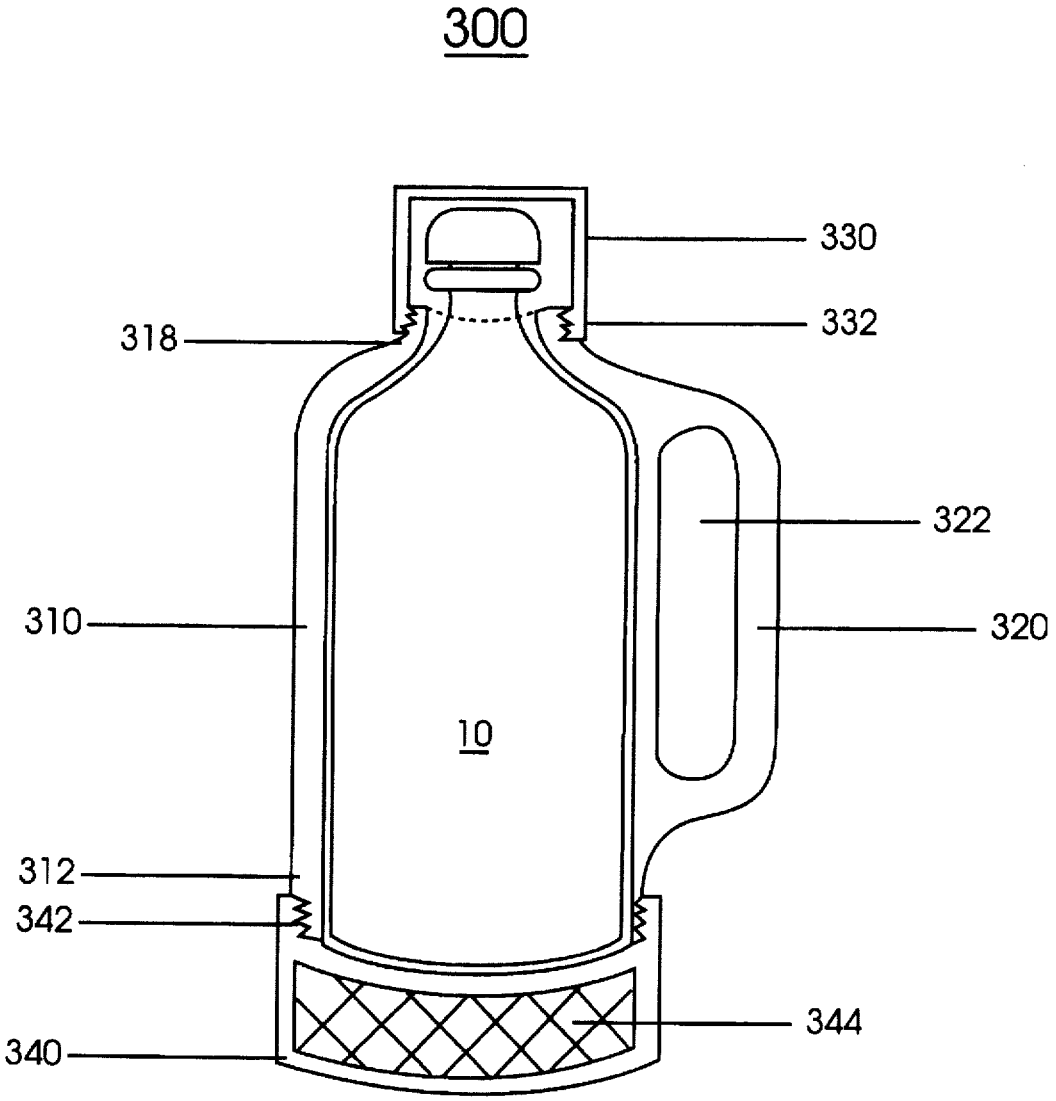
FIG. 3 is a cross-sectional view of a third preferred embodiment of the cooler invention.

FIG. 3 is a cross-sectional view of a third preferred embodiment 300 of the cooler invention. Here, outer container 3 10 can be formed from materials similar to the like components 110 in FIG. 1 or the double walls 210, 216, 218 in FIG. 2A. Referring to FIG. 3, the lower end 312 has threads attachable to mateable threads 342 on a removable bottom 340. The removable bottom 340 can also be formed from a plastic type material such as 140 in FIG. 1 and 240 in FIG. 2A. Referring to FIG. 3, removable bottom 340 can have a hollow interior 344 filled with a refrigerant material such as but not limited to Blue-ice, ice water and the like. Before use, only the bottom end 340 needs to be stored in a refrigerator or freezer. The top end 318 of casing 3 10 has threads 318 that are mateable to interior threads 332 of an exterior cap 330, the latter of which can also be used as a drinking cup. Bottle 10 can be inserted into cooler 300 by unscrewing bottom end 340. During use cap 310 can be unscrewed. Similar to FIG. 2A and 2B, cooler 300 can be used without bottle 10 by unscrewing cap 330 and just pouring liquid through the opening at the cap end. Handle 320 is the same configuration as 220 in FIG. 2A and 322 is the same as 222 in FIG. 2A respectively.

FOURTH PREFERRED EMBODIMENT

Figure 4:
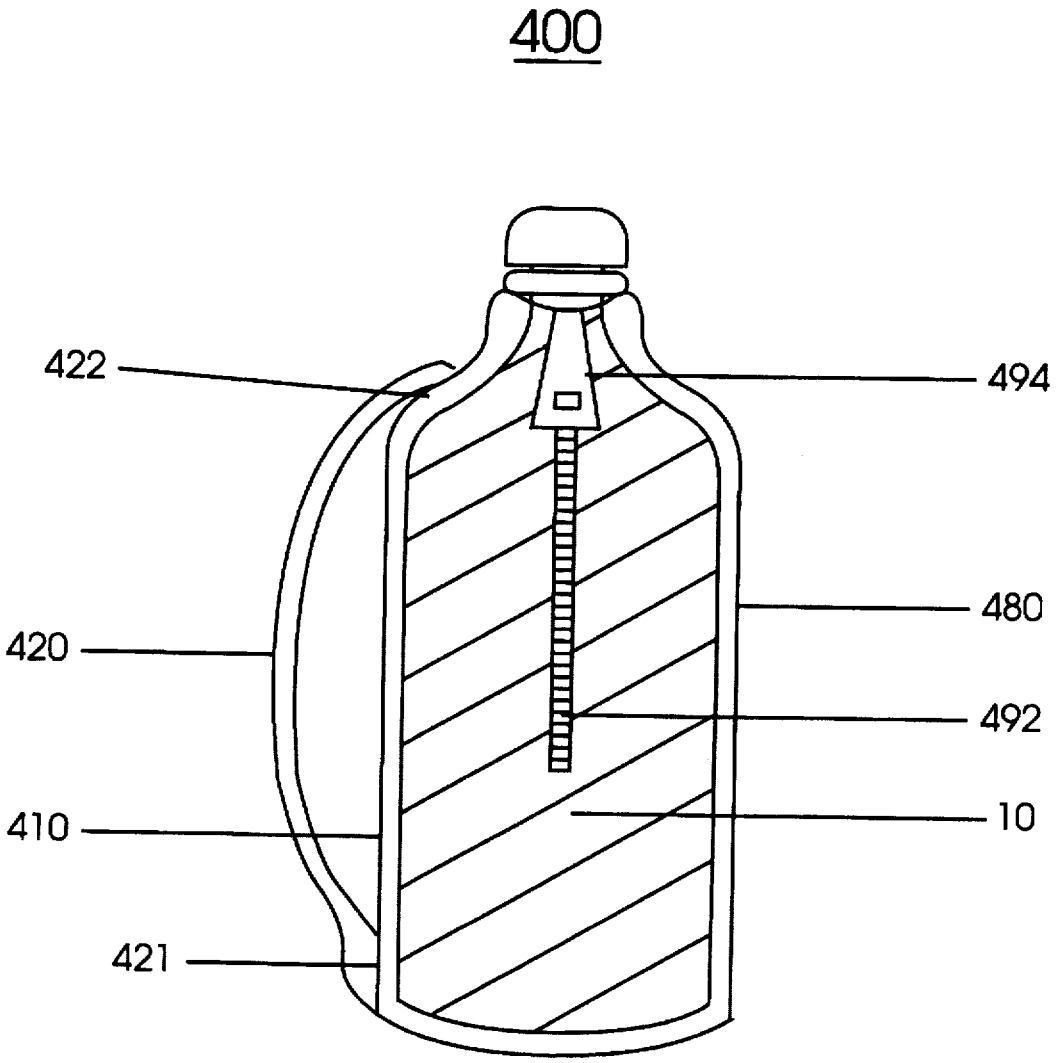
FIG. 4 is a side view of a fourth preferred embodiment of the cooler invention.

FIG. 4 is a side view of a fourth preferred embodiment 400 of the cooler invention. The sides of this cooler embodiment 400 contains a vulcanized rubber material 410 such as but not limited to the types of material used in wet suits and the like. The exterior of embodiment 400 is shown at 480, which can be a waterproof material such as but not limited to nylon, synthetic cloth and the like. Handle 420 can be formed from a rigid plastic material such as like components 110, 210 and 310 discussed previously. Handle 420 can be adhered to material 410 by glue, cement, stitching and the like and combinations thereof. A zipper 492 with tab 494 is opened in order to place bottle 10 inside. The rubber material 480 has natural insulative qualities for keeping the contents of bottle 10 at chilled temperatures. Alternatively, material 480 can keep contents at warmed temperatures. In this embodiment, bottle 10 is refrigerated by itself, or within cooler embodiment 400 before being used.

FIFTH PREFERRED EMBODIMENT

Figure 5:
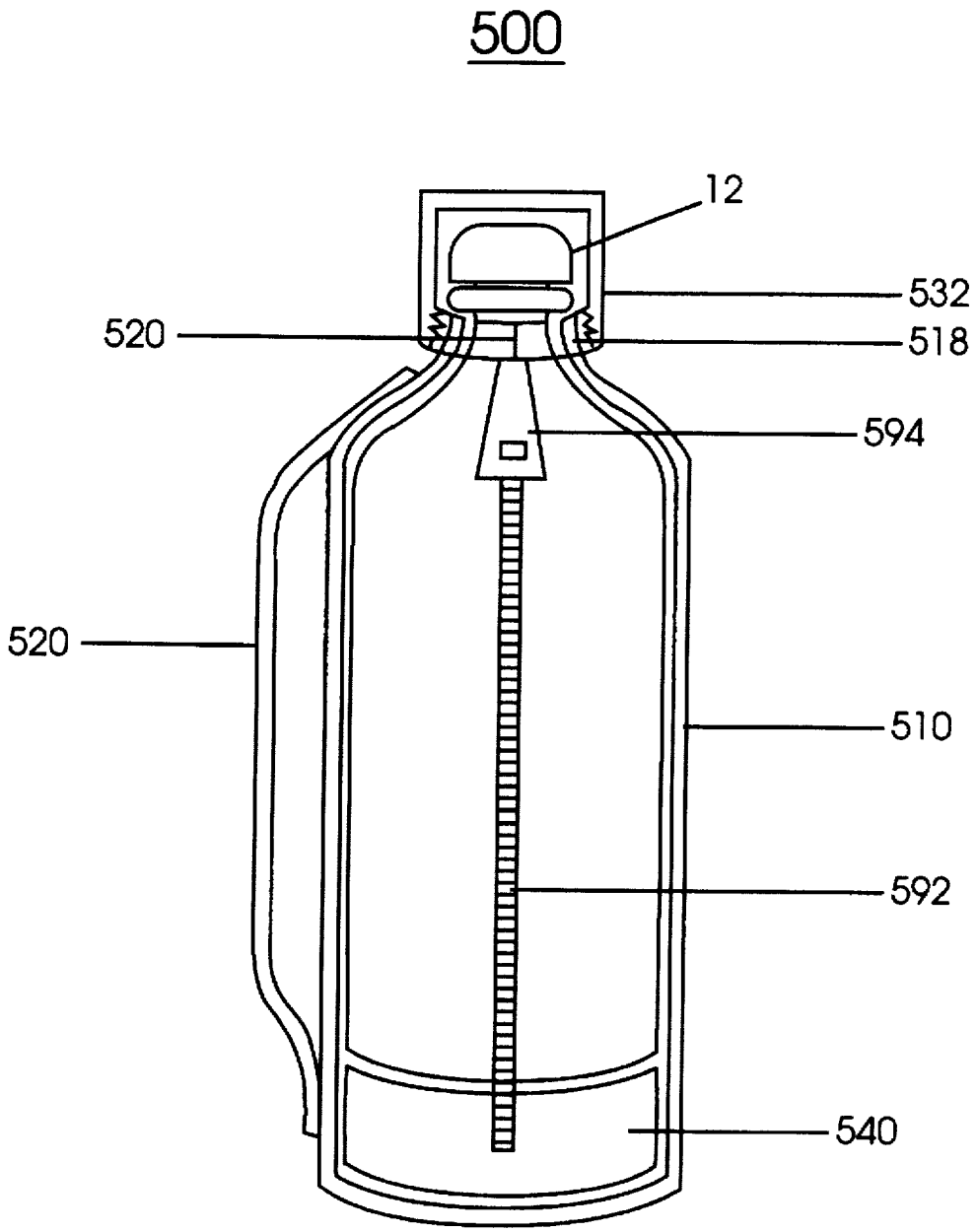
FIG. 5 is a cross-sectional view of a fifth preferred embodiment of the cooler invention.

FIG. 5 is a cross-sectional view of a fifth preferred embodiment 500 of the cooler invention. The embodiment of FIG. 5 is similar to the embodiment depicted in FIG. 4 with several modifications. Components 510, 520, 592, 594 correspond to like components in FIG. 4. However, the base of FIG. 5 is extended in order to receive a removable frigerant container 540 such as but not limited to Blue-ice, bag of frozen water, and the like. Furthermore, a cylindrical type ting 518 with exterior threads thereon is adhered to the neck portion of material 510 by glue, cement, stitching and the like in order to allow bottle neck and cap 12 to protrude through. A plastic cap 532 with interior threads mateable to threads on ring 518 is screwable on embodiment 500. Cap 532 can also be used as a drinking cup.

Although the invention has been described for holding and supporting 2 and 3 liter bottles, the invention would be applicable to holding, supporting and providing insulation for other types of bottles such as but not limited to 12 ounce, 16 ounce, quart, half-gallon and gallon containers.

The respective casings in each of the embodiments can be labelled with exterior advertising such that the bottles 10 within the respective coolers can have a different label such as that of a competitor on the exterior of the cooler inventions.

Although the embodiments are described for keeping the contents of stored bottles and liquids cooled or chilled, the invention can alternatively be used to keep contents warm or hot. For example, the embodiments of FIGS. 1 through 3 can be used to store coffee and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A portable holder for supporting and insulating the contents of a two liter disposable bottle located within the holder, comprising:

a substantially hollow cylindrical container formed from a molded high density plastic foam material, the container configured to wrap about and insulate a two liter disposable bottle;

a lid formed from a molded high density plastic foam material, the lid having an upper portion for abutting against a neck of the bottle and a lower connect portion that is removable from a mateable connect portion on the cylindrical container; and a single rounded handle having an indented recess layer disposed in a plane radially extending from said container, said handle further having a raised continuous rounded perimeter edge with a vertical portion disposed parallel to a side wall of the container and two horizontal portions disposed substantially perpendicular to said side wall of the container, with each horizontal portion respectively connected at one end to an upper and lower point on said side wall and each horizontal portion respectively attached at an other end to opposite ends of said vertical portion, so that said raised continuous rounded perimeter edge and said side wall thereby enclose a flat area and said indented recess layer is circumscribed by and contiguously attached to said side wall and said raised continuous rounded perimeter edge, said handle is formed from the same molded high density plastic foam material as the cylindrical container wherein said recess layer reinforces the connection between the raised continuous rounded perimeter edge and said side wall, and wherein the cylindrical container provides insulation for the two liter disposable bottle.

2. The portable holder of claim 1, wherein the cylindrical container includes:

double coaxial side walls with a hollow space therein.

3. The portable holder of claim 2, wherein the double coaxial side walls further include:

insulative foam within the hollow space.

4. The portable holder of claim 1, further comprising:

a bottom portion housing formed from the same molded high density plastic foam material as the cylindrical container and extending from beneath a lower portion of the cylindrical container and for supporting a package of freezable liquid, the bottom portion attached to and removable from a lower portion of the cylindrical container.

5. The portable holder of claim 4, wherein the freezable liquid in the package is chosen from at least one of:

water and blue ice.

6. The portable holder of claim 4, wherein the bottom portion includes:

a removable disc shaped pack filled with the freezable liquid located within the interior of the bottom portion.

7. The portable holder of claim 1, wherein the lid includes:

a dome shape having an upper opening for allowing the neck of the two liter bottle to extend therethrough, the dome having a lower connect snap portion for mateably snapping about a connect portion on the cylindrical container.

8. The portable holder of claim 1, wherein the lid includes:

a dome shape having an upper opening for allowing the neck of the two liter bottle to extend therethrough, the dome having a lower thread portion for mateably threading about a threaded portion on the cylindrical container.

9. A portable holder for supporting and insulating the contents of a two liter disposable bottle located within the holder, comprising:

a substantially hollow cylindrical container formed from unmolded high density plastic foam material, the container configured to wrap about and insulate a two liter disposable bottle;

a lid formed from a molded high density plastic foam material, the lid having an upper portion for abutting against a neck of the bottle and a lower connect portion that is removable from a mateable connect portion on the cylindrical container, wherein the lid includes:

a curved side for abutting against the neck of the two liter bottle; and a T-shaped groove on a lower surface which mateably slides over a protruding T-shaped portion on the cylindrical container to retain the two liter bottle within the container; and a single rounded handle having an indented recess portion on both sides, the handle formed from the same molded high density plastic foam material as the cylindrical container and attached to a side of the cylindrical container, wherein the cylindrical container provides insulation for the two liter disposable bottle.

* * * * *